US008955292B2

(12) United States Patent
Schraudolph

(10) Patent No.: US 8,955,292 B2
(45) Date of Patent: Feb. 17, 2015

(54) CAPPING DEVICE

(75) Inventor: Ulrich Johannes Schraudolph, Singapore (SG)

(73) Assignee: Xentiq Pte Ltd, Singapore (SG)

( * ) Notice: Subject to any disclaimer, the term of this patent is extended or adjusted under 35 U.S.C. 154(b) by 598 days.

(21) Appl. No.: 13/384,690

(22) PCT Filed: Jul. 22, 2009

(86) PCT No.: PCT/SG2009/000257

§ 371 (c)(1),
(2), (4) Date: Jan. 18, 2012

(87) PCT Pub. No.: WO2011/010963

PCT Pub. Date: Jan. 27, 2011

(65) Prior Publication Data

US 2012/0110950 A1 May 10, 2012

(51) Int. Cl.

| | |
|---|---|
| ***B67B 1/06*** | (2006.01) |
| ***B67B 3/20*** | (2006.01) |
| ***B65B 7/28*** | (2006.01) |

(52) U.S. Cl.

CPC ..... *B67B 3/2006* (2013.01); *B65B 7/2835* (2013.01)

USPC ..... 53/331.5; 53/306; 53/310; 53/317

(58) Field of Classification Search

CPC ..... B65B 7/28; B65B 7/2807; B65B 7/2821; B65B 7/2828; B65B 7/2835; B65B 7/2842; B67B 1/004; B67B 1/04; B67B 1/005; B67B 1/06; B67B 3/00; B67B 3/20

USPC ..... 53/307, 490, 287, 306, 310, 312, 317, 53/265, 331.5

See application file for complete search history.

(56) References Cited

U.S. PATENT DOCUMENTS

| | | | | |
|---|---|---|---|---|
| 2,440,030 A | | 4/1948 | Thomas | |
| 3,583,347 A | * | 6/1971 | Whitten et al. | 413/46 |
| 3,803,800 A | * | 4/1974 | Tavernier | 53/264 |
| 4,312,172 A | | 1/1982 | Fisher et al. | |

(Continued)

FOREIGN PATENT DOCUMENTS

| | | |
|---|---|---|
| GB | 489457 A | 7/1938 |
| GB | 649328 A | 1/1951 |

OTHER PUBLICATIONS

International Search Report, mailing date Sep. 30, 2009, for corresponding International Application PCT/SG2009/000257.

(Continued)

*Primary Examiner* — Gloria R Weeks

(74) *Attorney, Agent, or Firm* — Intellectual Property Law Group LLP

(57) ABSTRACT

A device for fitting a screw cap to a container, the device comprising a guide (104) for insertion of a container (106) along a first axis (108), and a holding area (110) for loading of the cap(s) (114) along a second axis (116). The holding area is coupled to the guide so as to form a channel (112) therebetween. A slider (118) is movable along the channel so as to allow loading of the cap into the holding area and subsequently bring the cap into contact with a rotating engaging element (120). The slider holds the cap in place against the rotating engaging element while it rotates to fit the cap to the container. The first axis is different from the second axis such that the cap is supported by a portion of the guide upon release from the holding area.

21 Claims, 6 Drawing Sheets

(56) References Cited

U.S. PATENT DOCUMENTS

| | | | | | |
|---|---|---|---|---|---|
| 5,048,259 | A * | 9/1991 | Cox et al. | 53/132.1 |
| 5,095,681 | A * | 3/1992 | Choi | 53/306 |
| 5,115,617 | A * | 5/1992 | Lewis et al. | 53/306 |
| 5,280,693 | A * | 1/1994 | Heudecker | 53/306 |
| 5,309,696 | A * | 5/1994 | Heudecker et al. | 53/306 |
| 5,398,480 | A | 3/1995 | Bankuty | |
| 5,400,564 | A * | 3/1995 | Humphries et al. | 53/75 |
| 5,493,849 | A * | 2/1996 | Itoh | 53/489 |
| 5,621,960 | A * | 4/1997 | Kaminski | 29/456 |
| 5,746,042 | A * | 5/1998 | Lombardi | 53/305 |
| 6,115,992 | A * | 9/2000 | Bankuty et al. | 53/308 |
| 6,161,367 | A * | 12/2000 | Walter | 53/478 |
| 6,341,472 | B1 * | 1/2002 | Schroeder | 53/426 |
| 6,430,896 | B1 * | 8/2002 | Torikian | 53/310 |
| 6,701,692 | B1 * | 3/2004 | Niehr | 53/167 |
| 7,469,517 | B2 * | 12/2008 | Moore et al. | 53/317 |
| 7,735,297 | B2 * | 6/2010 | Monti | 53/329 |
| 8,789,344 | B2 * | 7/2014 | Monti | 53/319 |
| 2001/0032437 | A1 | 10/2001 | Reinecke | |
| 2002/0017076 | A1 * | 2/2002 | Martin | 53/306 |
| 2007/0006550 | A1 * | 1/2007 | Kemper et al. | 53/426 |
| 2011/0083405 | A1 * | 4/2011 | Dewert et al. | 53/490 |

OTHER PUBLICATIONS

Written Opinion of International Searching Authority, mailing date Sep. 30, 2009, for corresponding International Application PCT/SG2009/000257.

* cited by examiner

CAPPING DEVICE

CROSS-REFERENCE TO RELATED APPLICATIONS

This application is a U.S. National Phase application, under 35 U.S.C. §371, of International Application no. PCT/SG2009/000257, with an international filing date of Jul. 22, 2009, which is hereby incorporated by reference for all purposes.

TECHNICAL FIELD

Embodiments relate to a capping device.

BACKGROUND

Capping devices for putting a cap onto a container are generally big and involve an assembly line configured to provide an automatic capping of the containers.

For use in a space-constrained environment, the state of the art capping devices may not be suitable. Therefore, there is a need for a simple, compact, robust and inexpensive capping device which can provide automatic capping of the containers.

SUMMARY

In various embodiments, a capping device for putting a cap onto a container may be provided. The capping device may include a guide configured for through insertion of the container along a first axis, a holding area coupled to the guide so as to form a channel between the guide and the holding area, the holding area configured for loading of the cap along a second axis, a slider disposed in the channel and configured to hold the cap in place when putting the cap onto the container and a rotating engaging element disposed at one end of the channel such that the slider and the rotating engaging element engage the cap when putting the cap onto the container; the rotating engaging element configured to rotate when putting the cap onto the container. The slider may be configured to be movable along the channel so as to allow loading of the cap into the holding area and to subsequently bring the cap into contact with the rotating engaging element and the first axis may be different from the second axis so that the cap may be supported by a portion of the guide upon release from the holding area.

BRIEF DESCRIPTION OF THE DRAWINGS

In the drawings, like reference characters generally refer to the same parts throughout the different views. The drawings are not necessarily to scale, emphasis instead generally being placed upon illustrating the principles of various embodiments. In the following description, various embodiments of the invention are described with reference to the following drawings, in which:

FIG. 2A' to 2E' show respective top views of a capping device during a process of putting a cap onto a container according to an embodiment.

DESCRIPTION

Figure 1:
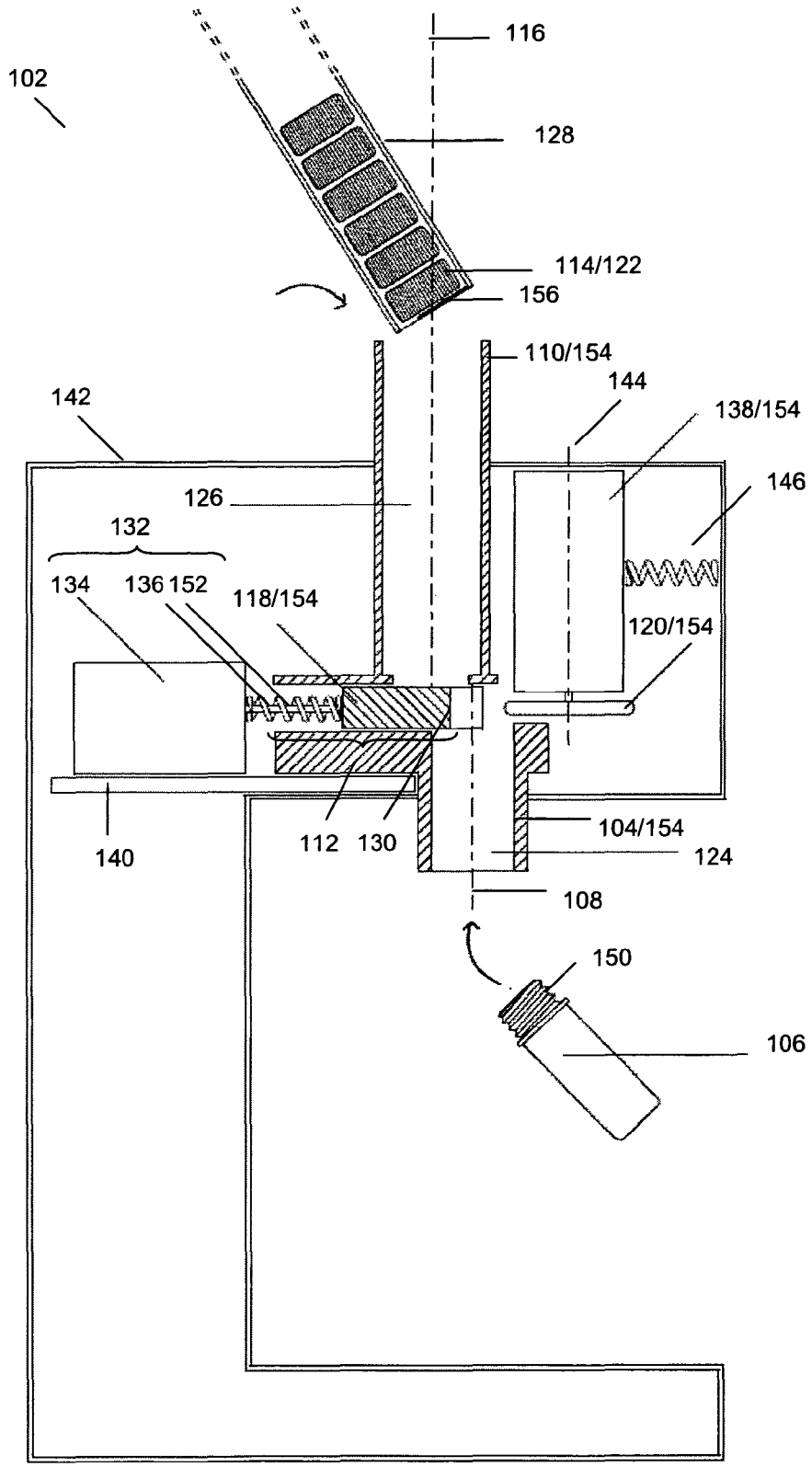
FIG. 1 shows a cross-sectional side view of a capping device according to an embodiment.

The following detailed description refers to the accompanying drawings that show, by way of illustration, specific details and embodiments in which the invention may be practiced. These embodiments are described in sufficient detail to enable those skilled in the art to practice the invention. Other embodiments may be utilized and structural, logical, and electrical changes may be made without departing from the scope of the invention. The various embodiments are not necessarily mutually exclusive, as some embodiments can be combined with one or more other embodiments to form new embodiments.

The word "exemplary" is used herein to mean "serving as an example, instance, or illustration". Any embodiment or design described herein as "exemplary" is not necessarily to be construed as preferred or advantageous over other embodiments or designs.

In various embodiments, a capping device may be provided, which maybe suitable for a space-constrained environment, for example a laboratory.

An embodiment may provide a capping device for putting a cap onto a container. The capping device may include a guide configured for through insertion of the container along a first axis, a holding area coupled to the guide so as to form a channel between the guide and the holding area, the holding area configured for loading of the cap along a second axis, a slider disposed in the channel and configured to hold the cap in place when putting the cap onto the container and a rotating engaging element disposed at one end of the channel such that the slider and the rotating engaging element engage the cap when putting the cap onto the container. The rotating engaging element may be configured to rotate when putting the cap onto the container. The slider may be configured to be movable along the channel so as to allow loading of the cap into the holding area and to subsequently bring the cap into contact with the rotating engaging element. Further, the first axis may be different from the second axis so that the cap may be supported by a portion of the guide upon release from the holding area.

In an embodiment, the cap may include a substantially circular cross-sectional shape or any other suitable cross-sectional shape. The cap may also be of any suitable cross-sectional dimension or height, depending on user and design requirements. The cap may include exterior cap threads positioned on an exterior of the cap and interior cap threads positioned on an interior of the cap. The exterior cap threads may be complementary to teeth on the rotating engaging element. The exterior cap threads may be configured to engage the teeth on the rotating engaging element when putting the cap onto the container. The interior cap threads may be complementary to container threads positioned at a neck of the container. The interior cap threads are configured to engage the container threads when putting or screwing the cap onto the container. The exterior cap threads and the interior cap threads may be any suitable threads depending on user and design requirements.

In an embodiment, the container may be any suitable storage portion configured to store or house a sample. The container may include a substantially circular cross-sectional shape or any other suitable cross-sectional shape. The container may also be of any suitable cross-sectional dimension or height, depending on user and design requirements. The container may also be microtubes for laboratory usage.

In an embodiment, the guide may include a guide through-hole configured for through insertion of the container along a first axis. The guide through-hole may include a substantially circular cross-sectional shape or any suitable cross-sectional shape. The guide through-hole may be of any suitable cross-sectional dimension or height, depending on the corresponding dimensions of the cap and/or container. The cross-sectional dimension of the guide through-hole may be comparable or larger than the cross-sectional dimension of the cap and/or container. The guide through-hole may include a certain height so as to provide a pathway in order to direct the container to the cap so as to be capped.

In an embodiment, the holding area may include a holding area through-hole configured for loading of the caps along a second axis. The caps may be loaded directly into the holding area or may be housed in a housing before being loaded into the holding area. One end or both ends of the housing may be sealed so as to prevent the caps from falling out before being loaded into the holding area. Upon contact of the housing with a bottom portion of the holding area, one of the sealed ends of the housing may be broken in order to release the caps into the holding area. The holding area or the housing may be an elongated portion, for example a tubular or cylindrical portion. The holding area or the housing may be of a substantially circular cross-sectional shape or any suitable cross-sectional shape so as to accommodate the caps. The holding area or the housing may also be of any suitable cross-sectional dimension or height in order to accommodate the caps. The housing area or the housing may be sized accordingly depending on the number of caps to be accommodated therein. One end of the holding area where the caps or housing to be loaded may be open-ended or close depending on user and design requirements.

In an embodiment, the housing may include a sliding tag positioned at one end or a bottom portion of the housing or cartridge. The sliding tag may obstruct an opening of the housing and may prevent the caps from falling out of the housing. After engaging the housing into the holding area, the sliding tag may be manually or automatically retracted.

In an embodiment, the housing may include a shutter, for example a spring, positioned at one end or a bottom portion of the housing or cartridge. The shutter, like the sliding tag may obstruct the opening of the housing and may prevent the caps from falling out of the housing. When engaging the housing, the shutter may be pushed back automatically by a cam positioned on a top portion of the holding area so the caps may be released into the holding area. On top of the housing, there may be a simple lid.

In an embodiment, the channel may be shaped and/or sized so as to accommodate the slider. The channel may also be of a substantially rectangular or circular cross-sectional shape or any suitable cross-sectional shape so as to accommodate the slider. The channel may be an elongated portion, for example a tubular or cylindrical portion. The channel may be of any suitable cross-sectional dimension or length in order to accommodate the sliding movement of the slider housed therein. The channel may be of a uniform dimension along the length of the channel.

In an embodiment, the slider may be configured to hold the cap in place when putting the cap onto the container. The slider may include a cap holding portion which may be complementary to the shape of the cap so as to hold the cap in place when putting the cap onto the container. The cap holding portion may be partially enclosed or fully enclosed. The cap holding portion may be a substantially semi-circular portion or a substantially circular portion. The cap holding portion may also include any suitable shaped portion which may be complementary to the shape of the cap. The slider may be of any suitable cross-sectional shape or dimension or length so as to be accommodated within the channel.

In an embodiment, the rotating engaging element may include teeth configured to engage the cap when putting the cap onto the container. The teeth may be positioned on an external rim of the rotating engaging element and configured to engage the exterior cap threads when putting the cap onto the container. The rotating engaging element may include a substantially circular cross-sectional shape or any other suitable cross-sectional shape. The rotating engaging element may also be of any suitable cross-sectional dimension depending on space available, user and design requirements. The rotating engaging element may also be termed the capping wheel.

In an embodiment, the capping device may further include a control mechanism coupled to the slider. The control mechanism may be a single integrated device or may include separate components. The control mechanism as a single integrated device may be configured to pull the slider towards the control mechanism and to push the slider away from the control mechanism. Alternatively, the control mechanism when including separate components, may be configured such that one component may be configured to pull the slider towards the control mechanism and the other component may be configured to push the slider away from the control mechanism.

In an embodiment, the control mechanism may include a first driving mechanism and a first elastic element, the first elastic element positioned between the first driving mechanism and the slider.

In an embodiment, the first driving mechanism may be configured to pull the slider towards the first driving mechanism and the first elastic element may be configured to push the slider away from the first driving mechanism.

In an embodiment, the first driving mechanism may be configured to push the slider away from the first driving mechanism and the first elastic element may be configured to pull the slider towards the first driving mechanism.

In an embodiment, the first elastic element may include a spring. The first elastic element may be any suitable element which may be configured to push the slider away from the first driving mechanism or to pull the slider towards the first driving mechanism.

In an embodiment, the first driving mechanism may include a solenoid or a motor. The first driving mechanism may be a linear mechanism. The first driving mechanism may be coupled to the slider via a interconnecting portion, for example a rod. The first elastic element may be configured such that the first elastic element may surround the interconnecting portion.

In an embodiment, the control mechanism may include a single integrated device such as a linear motor, a motor with rack and pinion drive or a motor with lead screw.

In an embodiment, the capping device may further include a second driving mechanism coupled to the rotating engaging element, the second driving mechanism may be configured to turn or rotate the rotating engaging element. The second driving mechanism may be a rotational mechanism.

In an embodiment, the second driving mechanism may further include a motor.

In an embodiment, the guide, the holding area, the slider, the rotating engaging element and the second driving mechanism may be integrally formed as an assembly arrangement. The guide, the holding area, the slider, the rotating engaging element and the second driving mechanism may be formed in a single process and may be of the same material.

In an embodiment, the capping device may further include a base plate. The base plate may be of a suitable dimension so as to accommodate the assembly arrangement. The base plate may be of the same material as the guide, the holding area, the slider, the rotating engaging element and the second driving mechanism.

In an embodiment, the control mechanism may be disposed on the base plate. The control mechanism may be adhered to the base plate or positioned on the base plate.

In an embodiment, the assembly arrangement may be coupled to the base plate such that the guide may be in contact with the base plate. The assembly arrangement may be mounted onto the base plate such that the assembly arrangement is fixed onto the base plate. The assembly arrangement may be coupled to the base plate at any suitable angle depending on user and design requirements.

In an embodiment, the capping device may further include a support structure. The support structure may be configured so that the capping device may be a standalone device. The capping device may be suitable for positioning on a laboratory bench for example.

In an embodiment, the base plate, a portion of the assembly arrangement and the control mechanism may be positioned within the support structure. The support structure may be sized such that the support structure may be able to accommodate the base plate, a portion of the assembly arrangement and the control mechanism In an embodiment, the rotating engaging element may be positioned relative to the guide and the holding area such that the rotating engaging element may rotate along a third axis, the third axis being different from the first axis and the second axis. The first axis, the second axis and the third axis may be parallel to each other and may be respectively spaced at a distance away from each other. Each of the first axis, the second axis and the third axis may be substantially perpendicular to the base plate.

In an embodiment, the second driving mechanism may be further coupled to the support structure via a second elastic element.

In an embodiment, the second elastic element may include a spring.

In an embodiment, the second elastic element may include a spring force less than the first elastic element. To allow the putting of the cap onto the container, the spring force of the second elastic element may be configured such that spring force of the second elastic element may include a lesser spring force than spring force of the first elastic element pushing the slider away from the first driving mechanism. The spring force of the second elastic element may not be sufficient to push the slider back towards the first driving mechanism.

In an embodiment, the capping device may further include a sensor positioned along the channel so as to detect a presence or absence of the cap in contact with the rotating engaging element. The sensor may be positioned in the wall of the channel between the guide and the holding area. Upon detection of the absence of the cap after the cap may have been put onto the container, the sensor may activate the microcontroller such that the slider may move along the channel so as to allow loading of the cap into the holding area and to subsequently bring the cap into contact with the rotating engaging element.

In an embodiment, the capping device may further include a microcontroller disposed on the base plate, wherein the microcontroller may be configured to control the first driving mechanism which actuate the slider so as to allow loading of the cap into the holding area and to subsequently bring the cap into contact with the rotating engaging element upon detection by the sensor of an absence of the cap in contact with the rotating engaging element.

In an embodiment, the caps may be stored in a holding area or tubular cartridge. The slider may be actuated by the first driving mechanism and may push the lowest cap in the holding area to a position for capping. At the position for capping, the cap to be put on the container may be in contact with the rotating engaging element, which may be spin mounted on the second driving mechanism, causing the cap in turn to spin. Also at the position for capping, the cap holding portion of the slider may be aligned with the guide through-hole, which may allow the user to introduce the containers or microtubes manually into the spinning cap. When the slider may be retracted, the holding area through-hole may be aligned with the cap holding portion of the slider, allowing a cap from the holding area to drop into the cap holding portion of the slider. In an embodiment, the operation of the capping device for putting the cap onto the container may be as such. Firstly, in an idle position, the caps in the holding area or housing may be at rest on a section of the slider which interferes with the tubular cross-section of the holding area. To illustrate this, in the idle position where the slider may be moved forward towards the rotating engaging element by the spring force of the first elastic element so as to allow loading of the caps into the holding area, the cap holding portion or cylindrical opening configured to accommodate the cap may be slightly offset from the second axis in the holding area. Due to the offset of the two axis (parallel axis of the holding area and guide, i.e. the first axis and the second axis), the caps above the slider may come to rest on a portion of the slider which may intersect with the cylindrical opening or tubular cross-section of the holding area. When the slider may be retracted again, the cap holding portion or the cylindrical opening may be aligned with the holding area again and the next cap may drop into the slider.

Next, when the capping device may be switched on, the microcontroller or microprocessor based controller may activate the first driving mechanism so as to pull back the slider such that the cap holding portion may be aligned with the cross-section of the holding area. The lowest cap in the holding area may slide into the cap holding portion in the slider (which may include approximately height of one cap) due to gravity and the whole column of caps in the holding area may be lowered by one cap height. At the same time, the second driving mechanism may be switched on and the rotating engaging element or capping wheel may spin.

Further, after the slider may be completely pulled back, the slider may pause slightly to ensure that the lowest cap in the holding area may dropped into the cap holding portion of the slider. After the pause, the slider may be released and the first elastic element may push the slider forward to a stop, moving the cap with it such that at the end position or capping position, the cap holding portion of the slider may be aligned with the guide through-hole in the guide below. At this position, the cap may be engaged with the rotating engaging element and a constant spring force provided by the second elastic element may push the rotating engaging element against the cap. The spring force provided by the second elastic element may not sufficient to push the slider back, as the spring force provided by the second elastic element may include a lesser force than the spring force provided by the first elastic element pushing the slider. Due to the spinning motion of the rotating engaging element as provided by the second driving mechanism, the cap may spin together with the rotating engaging element inside the cap holding portion of the slider. At the same time, the contact of the rotating engaging element with the cap may prevent the cap from dropping through the guide through-hole of the guide or tube guide out of the capping device.

Even further, the container or microtube may now be manually introduced into the guide through-hole of the guide, which may align the container with the spinning cap. When the container may be pushed up against the cap, the cap may be screwed onto the container due to the spinning motion of the cap.

When the container may be capped, which may be felt by a slight rotational force when holding the container, the container may be retracted manually by pulling the container down against the friction of the rotating engaging element. By pulling down the container, the capped container may be removed from the capping device. An optical sensor which may detect the cap in the cap holding portion of the slider may relay to the microcontroller that the cap may have been removed, upon which the slider may be retracted to engage the next cap and the cycle may repeat from when the capping device may be switched on.

FIG. 1 shows a cross-sectional side view of a capping device 102 according to an embodiment.

The capping device 102 may include a guide 104 configured for through insertion of a container 106 along a first axis 108, a holding area 110 coupled to the guide 104 so as to form a channel 112 between the guide 104 and the holding area 110, the holding area 110 configured for loading of the cap(s) 114 along a second axis 116, a slider 118 disposed in the channel 112 and configured to hold the cap 114 in place when putting the cap 114 onto the container 106 and a rotating engaging element 120 disposed at one end of the channel 112 such that the slider 118 and the rotating engaging element 120 engage the cap 114 when putting the cap 114 onto the container 106. The rotating engaging element 120 may be configured to rotate when putting the cap 114 onto the container 106. The slider 118 may be configured to be movable along the channel 112 so as to allow loading of the cap 114 into the holding area 110 and to subsequently bring the cap 114 into contact with the rotating engaging element 120. Further, the first axis 108 may be different from the second axis 116 so that the cap 114 may be supported by a portion of the guide 104 upon release from the holding area 110.

The cap 114 may include a substantially circular cross-sectional shape. The cap 114 may include exterior cap threads 122 positioned on an exterior of the cap 114 and interior cap threads (not shown) positioned on an interior of the cap 114. The exterior cap threads 122 may be complementary to teeth (not shown) on the rotating engaging element 120. The exterior cap threads 122 may be configured to engage the teeth on the rotating engaging element 120 when putting the cap 114 onto the container 106. The interior cap threads may be complementary to container threads 150 positioned at a neck of the container 106. The interior cap threads are configured to engage the container threads 150 when putting the cap 114 onto the container 106. The exterior cap threads 122 and the interior cap threads may be any suitable threads depending on user and design requirements.

The container 106 may be any suitable storage portion configured to store or house a sample. The container 106 may include a substantially circular cross-sectional shape or any other suitable cross-sectional shape. The container 106 may also be microtubes for laboratory usage.

The guide 104 may include a guide through-hole 124 configured for through insertion of the container 106 along the first axis 108. The guide through-hole 124 may include a substantially circular cross-sectional shape or any suitable cross-sectional shape. The guide through-hole 124 may be of any suitable cross-sectional dimension or height, depending on the corresponding dimensions of the cap 114 and/or container 106. The cross-sectional dimension of the guide through-hole 124 may be comparable or larger than the cross-sectional dimension of the cap 114 and/or container 106. The guide through-hole 124 may include a certain height so as to provide a pathway in order to direct the container 106 to the cap 114 so as to be capped.

The holding area 110 may include a holding area through-hole 126 configured for loading of the caps 114 along a second axis 116. The caps 114 may be loaded directly into the holding area 110 or may be housed in a housing 128 before being loaded into the holding area 110. One end or both ends of the housing 128 may be sealed so as to prevent the caps 114 from falling out before being loaded into the holding area 110. In FIG. 1, the housing 128 may include a sliding tag 156 positioned at one end or a bottom portion of the housing 128. The sliding tag 156 may obstruct an opening of the housing 128 and may prevent the caps 114 from falling out of the housing 128. After engaging the housing 128 into the holding area 110, the sliding tag 156 may be manually retracted.

The holding area 110 or the housing 128 may be an elongated portion, for example a tubular or cylindrical portion. The holding area 110 or the housing 128 may be of a substantially circular cross-sectional shape or any suitable cross-sectional shape so as to accommodate the caps 114. The holding area 110 or the housing 128 may also be of any suitable cross-sectional dimension or height in order to accommodate the caps 114. The holding area 110 or the housing 128 may be sized accordingly depending on the number of caps 114 to be accommodated therein. One end of the holding area 110 where the caps 114 or housing 128 to be loaded may be open-ended or close depending on user and design requirements.

The channel 112 may be shaped and/or sized so as to accommodate the slider 118. The channel 112 may also be of a substantially rectangular cross-sectional shape or any suitable cross-sectional shape so as to accommodate the slider 118. The channel 112 may be an elongated portion, for example a tubular or cylindrical portion. The channel 112 may be of any suitable cross-sectional dimension or length in order to accommodate the sliding movement of the slider 118 housed therein. The channel 112 may be of a uniform dimension along the length of the channel 112.

The slider 118 may be configured to hold the cap 114 in place when putting the cap 114 onto the container 106. The slider 118 may include a cap holding portion 130 which may be complementary to the shape of the cap 114 so as to hold the cap 114 in place when putting the cap 114 onto the container 106. The cap holding portion 130 may be partially enclosed or fully enclosed. The cap holding portion 130 may be a substantially semi-circular portion or a substantially circular portion. The cap holding portion 130 may also include any suitable shaped portion which may be complementary to the shape of the cap. The slider 118 may be of any suitable cross-sectional shape or dimension or length so as to be accommodated within the channel 112.

The rotating engaging element 120 may include teeth (not shown) configured to engage the cap 114 when putting the cap 114 onto the container 106. The teeth may be positioned on an external rim of the rotating engaging element 120 and configured to engage the exterior cap threads 122 when putting the cap 114 onto the container 106. The rotating engaging element 120 may include a substantially circular cross-sectional shape or any other suitable cross-sectional shape. The rotating engaging element 120 may also be of any suitable cross-sectional dimension depending on space available, user and design requirements. The rotating engaging element 120 may also be termed the capping wheel.

The capping device 102 may further include a control mechanism 132 coupled to the slider 118. The control mechanism 132 may include a first driving mechanism 134 and a first elastic element 136, the first elastic element 136 positioned between the first driving mechanism 134 and the slider 118. The first driving mechanism 134 may be coupled to the slider 118 via a interconnecting portion 152, for example a rod. The first elastic element 136 may be configured such that the first elastic element 136 may surround the interconnecting portion 152.

The first driving mechanism 134 may be configured to pull the slider 118 towards the first driving mechanism 134 and the first elastic element 136 may be configured to push the slider 118 away from the first driving mechanism 134. Alternatively, the first driving mechanism 134 may be configured to push the slider 118 away from the first driving mechanism 134 and the first elastic element 136 may be configured to pull the slider 118 towards the first driving mechanism 134.

The first elastic element 136 may include a spring. The first elastic element 136 may be any suitable element which may be configured to push the slider 118 away from the first driving mechanism 134 or to pull the slider 118 towards the first driving mechanism 134. The first driving mechanism 134 may include a solenoid or a motor.

The capping device 102 may further include a second driving mechanism 138 coupled to the rotating engaging element 120, the second driving mechanism 138 may be configured to turn or rotate the rotating engaging element 120. The second driving mechanism 138 may further include a motor.

The guide 104, the holding area 110, the slider 118, the rotating engaging element 120 and the second driving mechanism 138 may be integrally formed as an assembly arrangement 154. The guide 104, the holding area 110, the slider 118, the rotating engaging element 120 and the second driving mechanism 138 may be formed in a single process or by different processes. The guide 104, the holding area 110, the slider 118, the rotating engaging element 120 and the second driving mechanism 138 may be of a same material or different material.

The capping device 102 may further include a base plate 140. The base plate 140 may be of a suitable dimension so as to accommodate the assembly arrangement 154. The base plate 140 may be of the same material as the guide 104, the holding area 110, the slider 118, the rotating engaging element 120 and the second driving mechanism 138.

The assembly arrangement 154 may be coupled to the base plate 140 such that the guide 104 may be in contact with the base plate 140. The assembly arrangement 154 may be coupled to the base plate 140 at any suitable angle depending on user and design requirements. The control mechanism 132 may also be disposed on the base plate 140 and coupled to the slider 118.

The capping device 102 may further include a support structure 142. The support structure 142 may be configured so that the capping device 102 may be a standalone device.

When fabricating the capping device 102, the assembly arrangement 154 may first be mounted onto the base plate 140 such that the assembly arrangement 154 may be fixed onto the base plate 140. The control mechanism 132 may then be coupled to the base plate 140 and to the slider 118 within the assembly arrangement 154. Then, the base plate 140, a portion of the assembly arrangement 154 and the control mechanism 132 may be positioned within the support structure 142. The support structure 142 may be sized such that the support structure 142 may be able to accommodate the base plate 140, the portion of the assembly arrangement 154 and the control mechanism 132

The rotating engaging element 120 may be positioned relative to the guide 104 and the holding area 110 such that the rotating engaging element 120 may rotate along a third axis 144, the third axis 144 being different from the first axis 108 and the second axis 116. The first axis 108, the second axis 116 and the third axis 144 may be parallel to each other and may be respectively spaced at a distance away from each other. Each of the first axis 108, the second axis 116 and the third axis 144 may be substantially perpendicular to the base plate 140.

The second driving mechanism 138 may be further coupled to the support structure 142 via a second elastic element 146. The second elastic element 146 may include a spring. The second elastic element 146 may include a spring force less than the first elastic element 136. To allow the putting of the cap 114 onto the container 106, the spring force of the second elastic element 146 may be configured such that spring force of the second elastic element 146 may include a lesser spring force than the spring force of the first elastic element 136 pushing the slider 118 away from the first driving mechanism 134. The spring force of the second elastic element 146 may not be sufficient to push the slider 118 back towards the first driving mechanism 134.

The capping device 102 may further include a sensor (not shown) positioned along the channel 112 so as to detect a presence or absence of the cap 114 in contact with the rotating engaging element 120. The sensor may be positioned in the wall of the channel 112 between the guide 104 and the holding area 110. Upon detection of the absence of the cap 114 after the cap 114 may have been put onto the container 106, the sensor may activate the microcontroller (not shown) (which will control or energise the first driving mechanism) such that the slider 118 may move along the channel 112 so as to allow loading of the cap 114 into the holding area 110 and to subsequently bring the cap 114 into contact with the rotating engaging element 120.

The capping device 102 may further include a microcontroller disposed on the base plate 140, wherein the microcontroller may be configured to control or energise the first driving mechanism in order to actuate the slider 118 so as to allow loading of the cap 114 into the holding area 110 and to subsequently bring the cap 114 into contact with the rotating engaging element 120 upon detection by the sensor of an absence of the cap 114 in contact with the rotating engaging element 120. The microcontroller may be positioned behind the first driving mechanism 134 in FIG. 1 or may be positioned at any suitable position on the base plate 140.

Figure 2A:
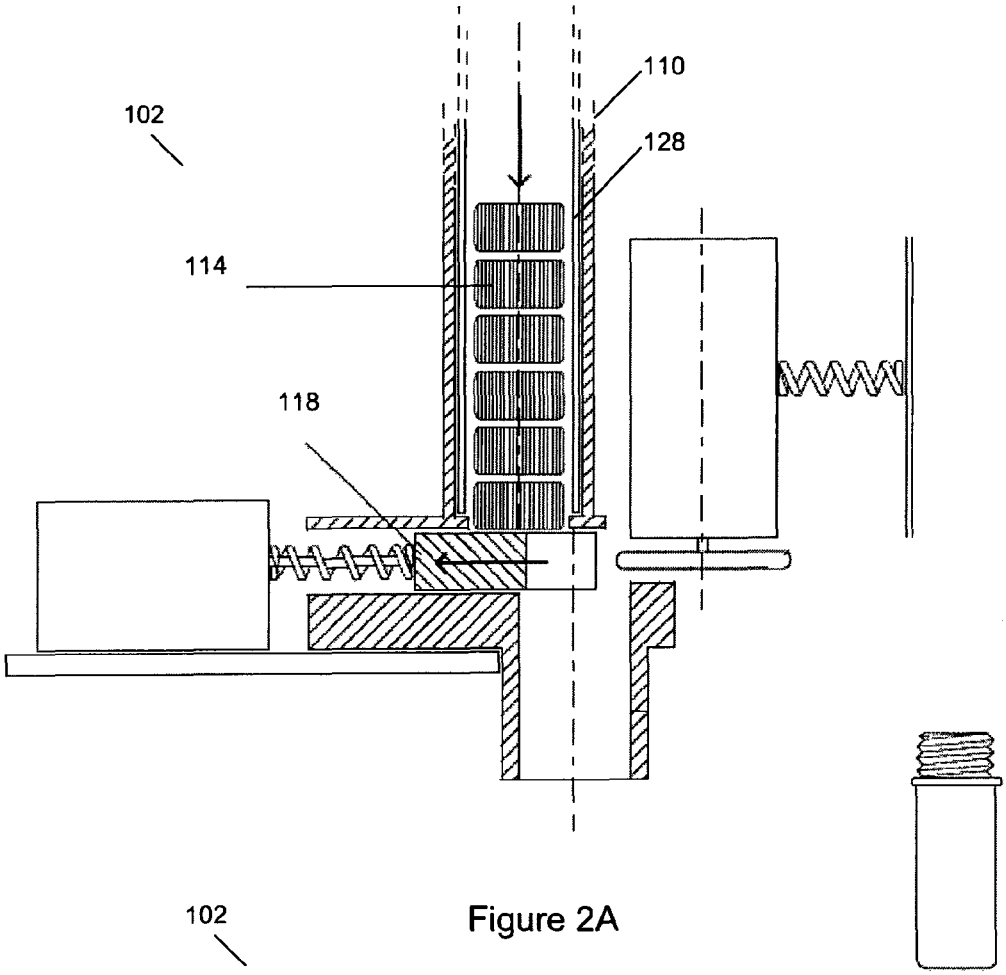
FIG. 2A to 2E show respective cross-sectional side views of a capping device during a process of putting a cap onto a container according to an embodiment.
Figure 2A:
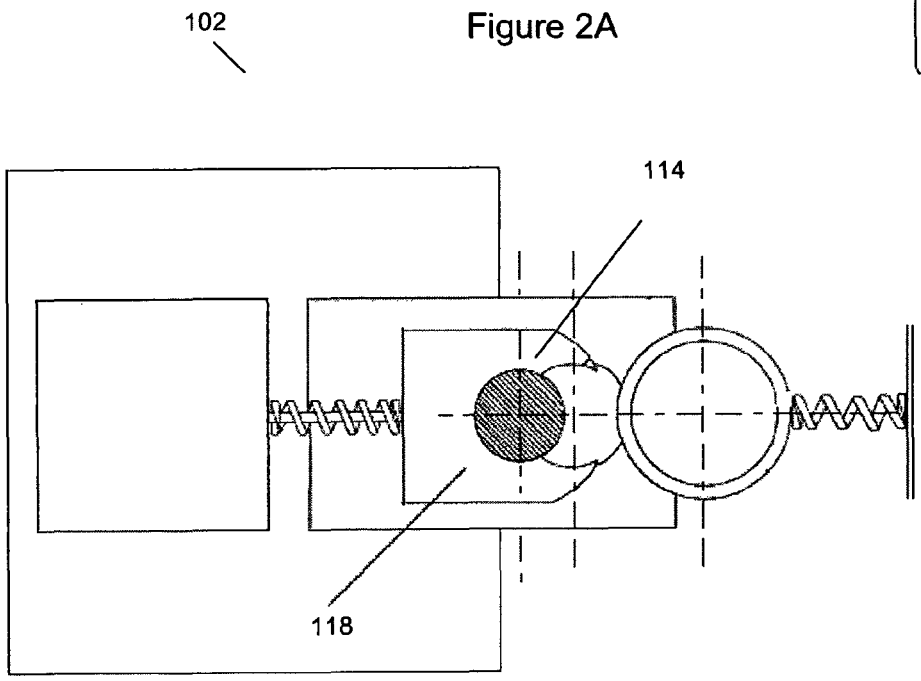

FIG. 2A to 2E show respective cross-sectional side views of a capping device 102 during a process of putting a cap 114 onto a container 106 according to an embodiment. FIG. 2A' to 2E' show respective top views of a capping device 102 during a process of putting a cap 114 onto a container 106 according to an embodiment.

FIG. 2A and FIG. 2A' show the capping device 102 in an idle position. In the idle position, the caps 114 in the housing 128 positioned within the holding area 110 may be at rest on a section of the slider 118 which interferes with the tubular cross-section of the holding area.

Figure 2B:
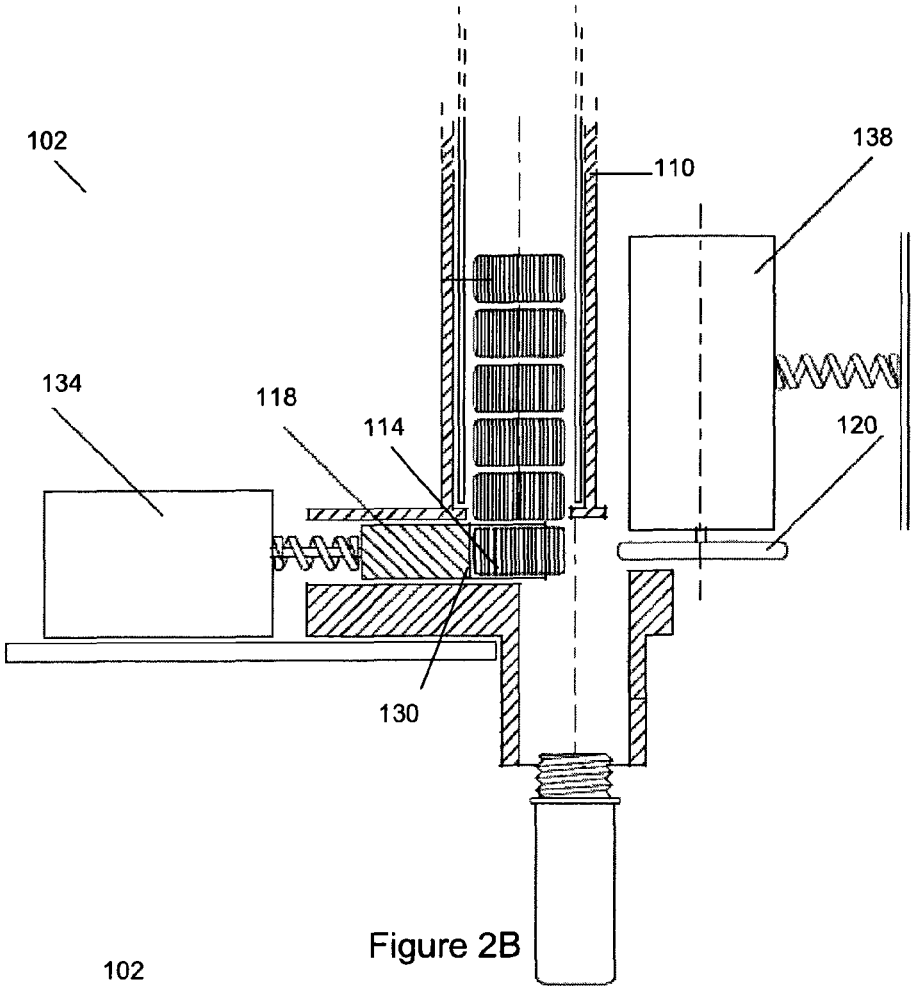
Figure 2B:
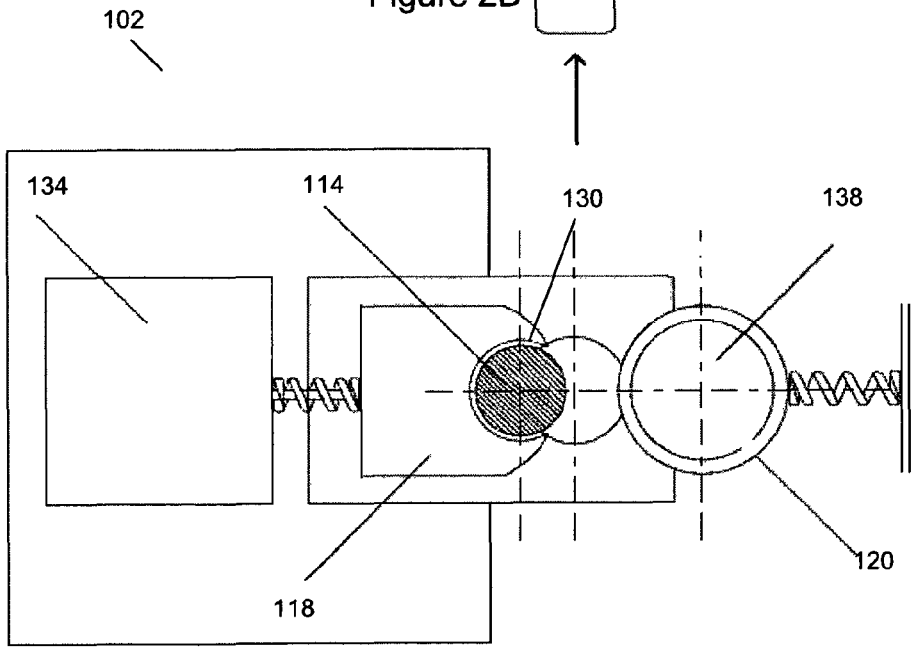

Next in FIG. 2B AND FIG. 2B', when the capping device 102 may be switched on, the microcontroller or microprocessor based controller (not shown) may activate the first driving mechanism 134 so as to pull back the slider 118 such that the cap holding portion 130 may be aligned with the cross-section of the holding area 110. The lowest cap 114 in the holding area 110 may slide into the cap holding portion 130 in the slider 118 (which may include approximately height of one cap) due to gravity and the whole column of caps 114 in the holding area 110 may be lowered by one cap height. At the same time, the second driving mechanism 138 may be switched on and the rotating engaging element 120 or capping wheel may spin.

Figure 2C:
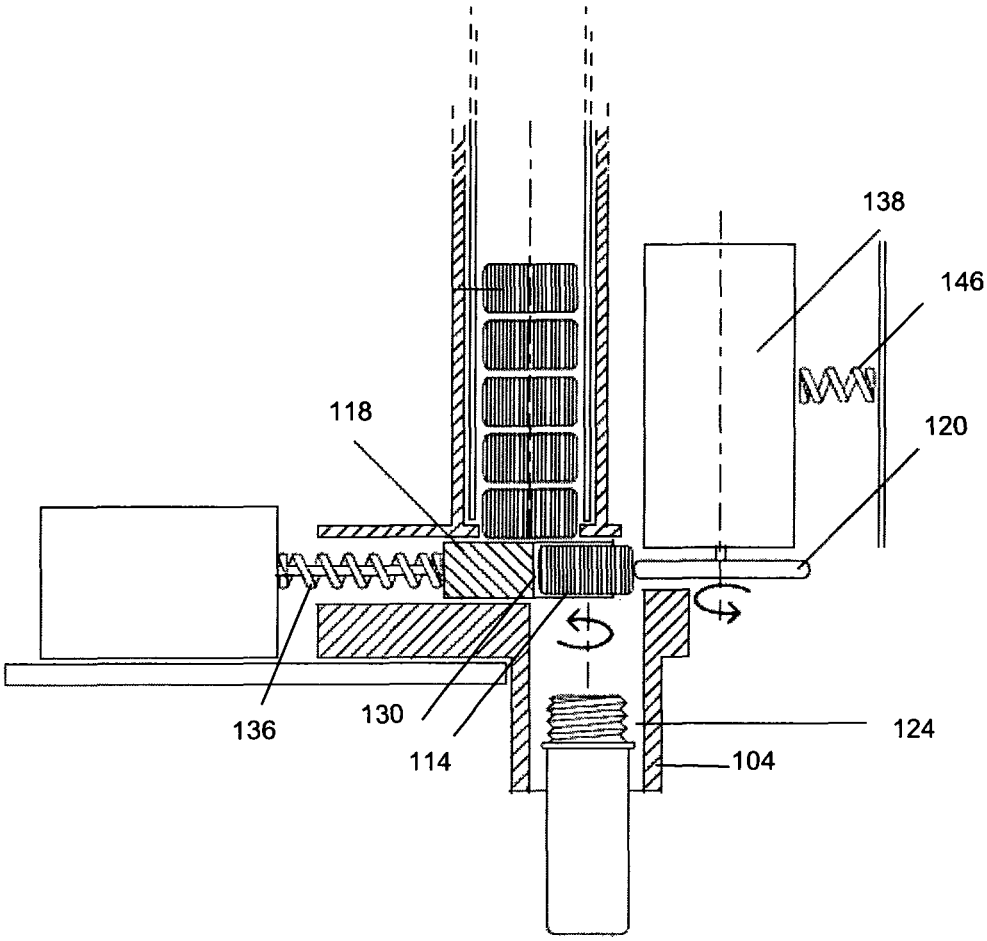
Figure 2C:
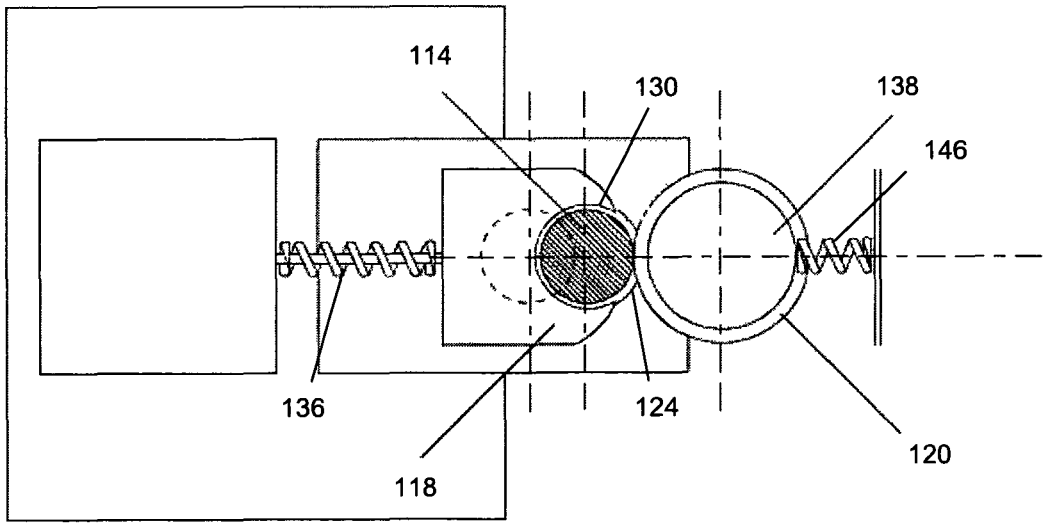

Further in FIG. 2C AND FIG. 2C', after the slider 118 may be completely pulled back, the slider 118 may pause slightly to ensure that the lowest cap 114 in the holding area 110 may dropped into the cap holding portion 130 of the slider 118. After the pause, the slider 118 may be released and the first elastic element 136 may push the slider 118 forward to a stop, moving the cap 114 with it such that at the end position or capping position, the cap holding portion 130 of the slider 118 may be aligned with the guide through-hole 124 in the guide 104 below. At this position, the cap 114 may be engaged with the rotating engaging element 120 and a constant spring force provided by the second elastic element 146 may push the rotating engaging element 120 against the cap 114. The spring force provided by the second elastic element 146 may not sufficient to push the slider 118 back, as the spring force provided by the second elastic element 146 may include a lesser force than the spring force provided by the first elastic element 136 pushing the slider 118. Due to the spinning motion of the rotating engaging element 120 as provided by the second driving mechanism 138, the cap 114 may spin together with the rotating engaging element 120 inside the cap holding portion 130 of the slider 118. At the same time, the contact of the rotating engaging element 120 with the cap 114 may prevent the cap 114 from dropping through the guide through-hole 124 of the guide or tube guide 104 out of the capping device 102.

Figure 2D:
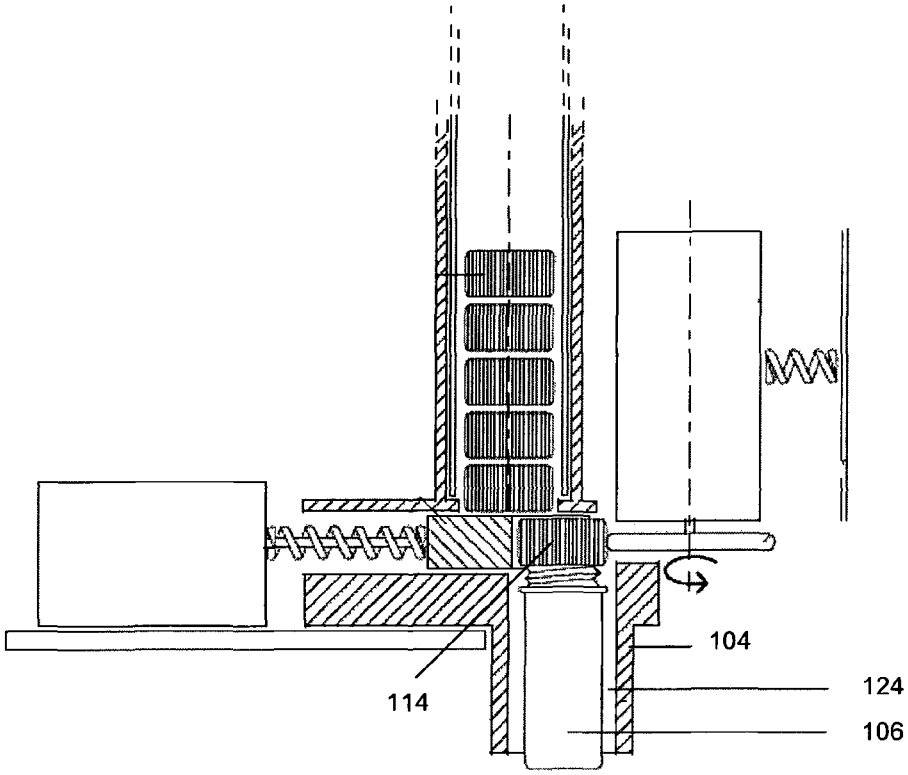
Figure 2D:
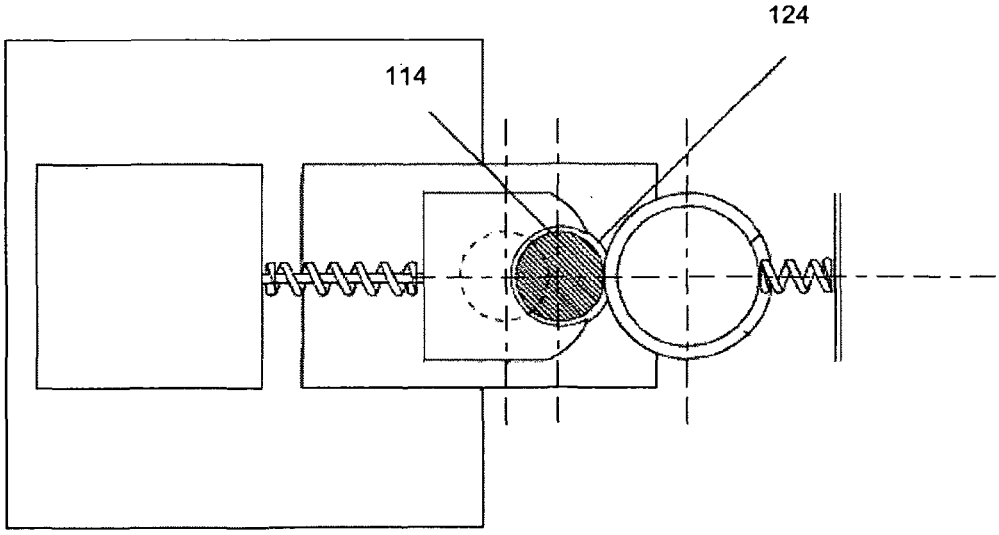

In FIG. 2D AND FIG. 2D', the container 106 or microtube may now be manually introduced into the guide through-hole 124 of the guide 104, which may align the container 106 with the spinning cap 114. When the container 106 may be pushed up against the cap 114, the cap 114 may be screwed onto the container 106 due to the spinning motion of the cap 114.

Figure 2E:
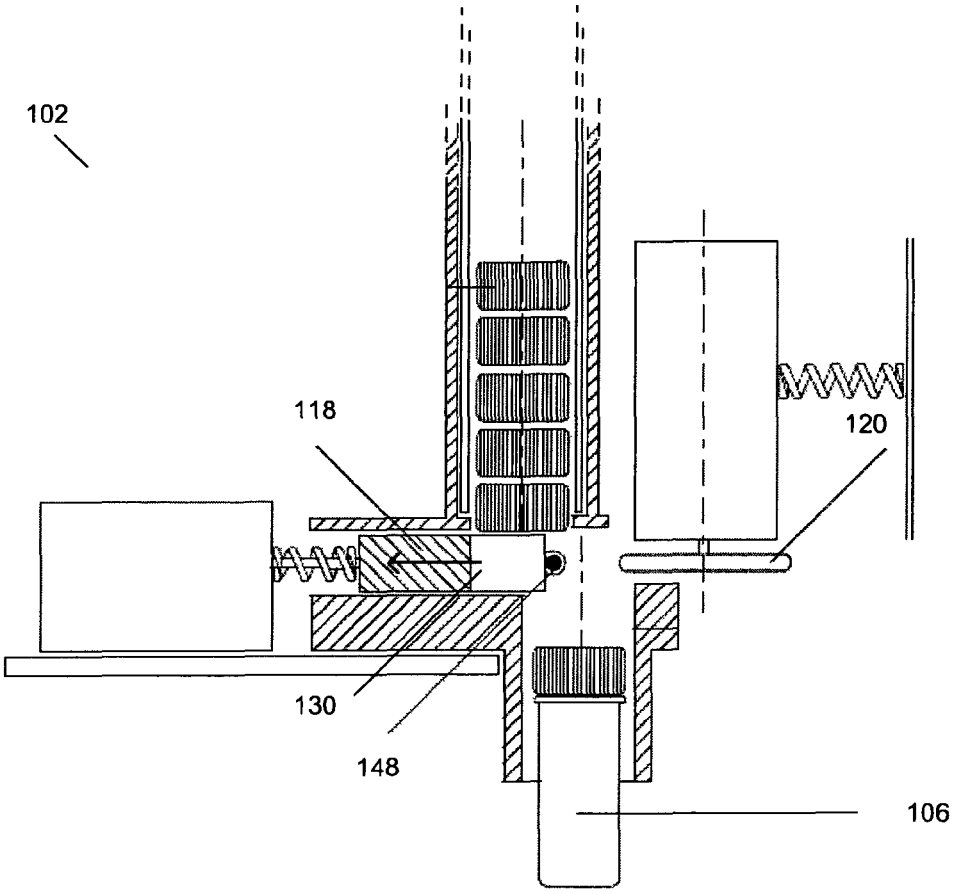
Figure 2E:
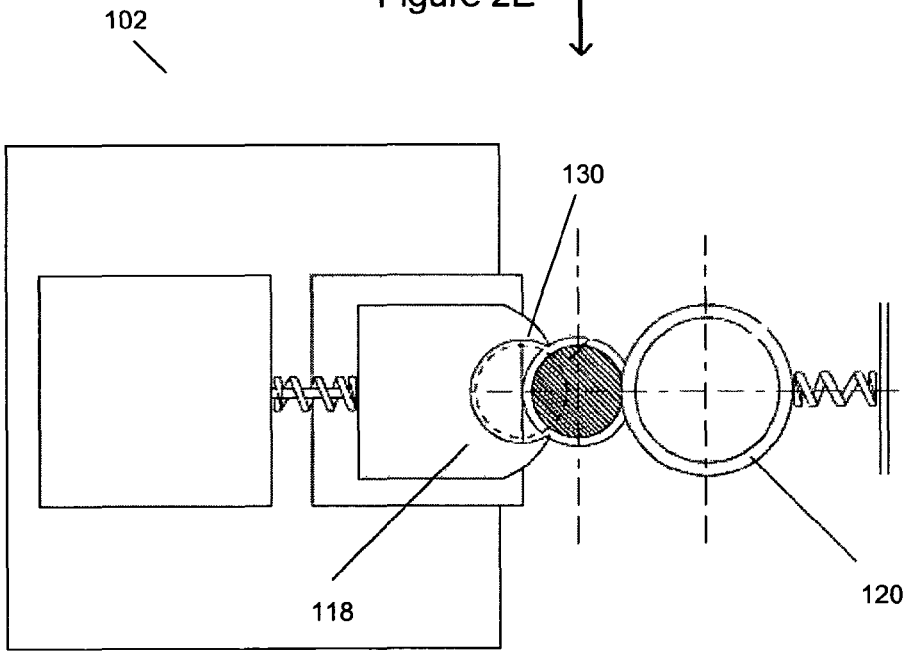

In FIG. 2E AND FIG. 2E', when the container 106 may be capped, which may be felt by a slight rotational force when holding the container 106, the container 106 may be retracted manually by pulling the container 106 down against the friction of the rotating engaging element 120. By pulling down the container 106, the capped container 106 may be removed from the capping device 102. An optical sensor 148 which may detect the cap 114 in the cap holding portion 130 of the slider 118 may relay to the microcontroller (not shown) that the cap 114 may have been removed, upon which the slider 118 may be retracted to engage the next cap 114 and the cycle may repeat from FIG. 2B when the capping device 102 may be switched on.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A capping device for putting a cap onto a container, the capping device comprising:

a guide configured for through insertion of the container along a first axis;

a holding area coupled to the guide so as to form a channel between the guide and the holding area, the holding area configured for loading of the cap along a second axis;

a slider disposed in the channel and configured to hold the cap in place when putting the cap onto the container; and a rotating engaging element disposed at one end of the channel such that the slider and the rotating engaging element engage the cap when putting the cap onto the container; the rotating engaging element configured to rotate when putting the cap onto the container;

wherein the slider is configured to be movable along the channel so as to allow loading of the cap into the holding area and to subsequently bring the cap into contact with the rotating engaging element; and wherein the first axis is different from the second axis so that the cap is supported by a portion of the guide upon release from the holding area.

2. The capping device of claim 1, further comprising a control mechanism coupled to the slider.

3. The capping device of claim 2, wherein the control mechanism comprises a linear motor, a motor with rack and pinion drive or a motor with lead screw.

4. The capping device of claim 2, wherein the control mechanism comprises a first driving mechanism and a first elastic element, the first elastic element positioned between the first driving mechanism and the slider.

5. The capping device of claim 4, wherein the first driving mechanism is configured to pull the slider towards the first driving mechanism and the first elastic element is configured to push the slider away from the first driving mechanism.

6. The capping device of claim 4, wherein the first driving mechanism is configured to push the slider away from the first driving mechanism and the first elastic element is configured to pull the slider towards the first driving mechanism.

7. The capping device of claim 4, wherein the first elastic element comprises a spring.

8. The capping device of claim 1, further comprising a second driving mechanism coupled to the rotating engaging element, the second driving mechanism is configured to turn the rotating engaging element.

9. The capping device of claim 8, wherein the second driving mechanism comprises a motor.

10. The capping device of claim 8, wherein the guide, the holding area, the slider, the rotating engaging element and the second driving mechanism are integrally formed as an assembly arrangement.

11. The capping device of claim 10, further comprising a base plate.

12. The capping device of claim 11, wherein the control mechanism is disposed on the base plate.

13. The capping device of claim 11, wherein the assembly arrangement is coupled to the base plate such that the guide is in contact with the base plate.

14. The capping device of claim 13, further comprising a support structure.

15. The capping device of claim 14, wherein the base plate, a portion of the assembly arrangement and the control mechanism are positioned within the support structure.

16. The capping device of claim 15, wherein the second driving mechanism is further coupled to the support structure via a second elastic element.

17. The capping device of claim 16, wherein the second elastic element comprises a spring.

18. The capping device of claim 16, wherein the second elastic element comprises a spring force less than the first elastic element.

19. The capping device of claim 1, wherein the rotating engaging element is positioned relative to the guide and the holding area such that the rotating engaging element rotates along a third axis, the third axis being different from the first axis and the second axis.

20. The capping device of claim 1, further comprising a sensor positioned along the channel so as to detect a presence or absence of the cap in contact with the rotating engaging element.

21. The capping device of claim 20, further comprising a microcontroller disposed on the base plate, wherein the microcontroller is configured to control the first driving mechanism which actuate the slider so as to allow loading of the cap into the holding area and to subsequently bring the cap into contact with the rotating engaging element upon detection by the sensor of an absence of the cap in contact with the rotating engaging element.

* * * * *